United States Patent [19]

Elliott

[11] Patent Number: 4,493,283

[45] Date of Patent: Jan. 15, 1985

[54] FLOATING BOAT DOCK ANCHOR

[76] Inventor: Richard E. Elliott, 17 Hope Rd., Mineral City, Ohio 44646

[21] Appl. No.: 497,760

[22] Filed: May 25, 1983

[51] Int. Cl.[3] ..... B63B 21/52

[52] U.S. Cl. ..... 114/263; 114/230

[58] Field of Search ..... 114/230, 263, 264, 265, 114/266, 267; 405/218, 219; 403/141, 142, 143; 441/3, 4, 5

[56] References Cited

U.S. PATENT DOCUMENTS

| | | | |
|---|---|---|---|
| 993,757 | 5/1911 | Chrysler . | |
| 2,260,442 | 10/1941 | Dollase | 403/141 |
| 2,837,357 | 6/1958 | Miller | 403/141 |
| 3,131,542 | 5/1964 | Koch | 114/266 |
| 3,152,568 | 10/1964 | Mayer | 114/266 |
| 4,028,899 | 6/1977 | Carmichael | 405/219 |
| 4,074,537 | 2/1978 | Gronlie | 405/218 |
| 4,193,368 | 3/1980 | DeGraaf et al. | 114/230 |
| 4,372,344 | 2/1983 | Stafford | 441/5 |

*Primary Examiner*—Trygve M. Blix
*Assistant Examiner*—Edwin L. Swinehart
*Attorney, Agent, or Firm*—Michael Sand Co.

[57] ABSTRACT

An anchor which secures a floating boat dock in position and which can be installed and removed easily from the dock for seasonal use. A base is permanently installed on the bottom of a lake and has a spherical ball projecting upwards from the base. A post has a socket formed in the bottom end which is provided with a pivotally mounted flap for capturing and releasing the spherical ball therein to removably mount the post on the base. A lever is attached to the upper end of the post and is connected to the flap for moving it between open and closed position. The post is loosely connected to the dock permitting limited movement of the dock with respect to the post. The post is movable on the spherical ball of the base permitting limited movement of the dock and post due to wave action reducing damage and fatigue on the anchor and dock. The lever is operated from the dock to attach and disconnect the post to and from the base enabling easy seasonal placement and removal of the dock after the initial installation of the bases.

9 Claims, 13 Drawing Figures

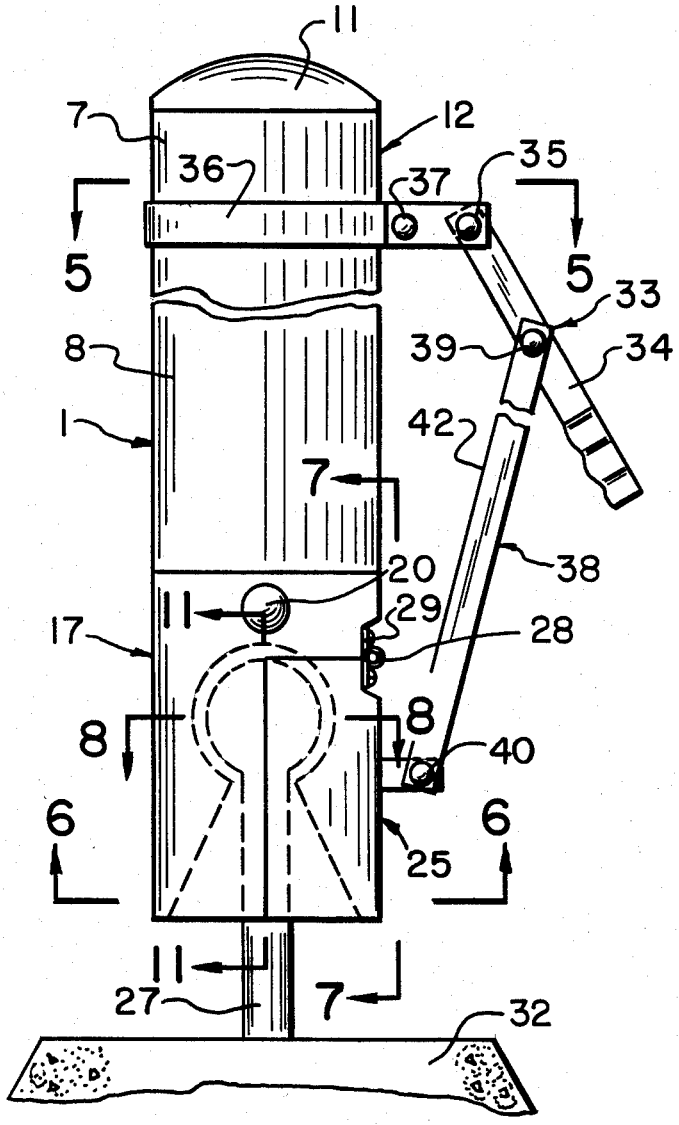
FIG. 4
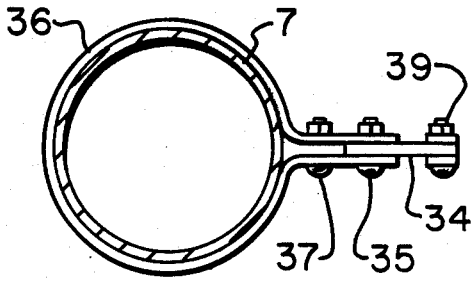
FIG. 5
FIG. 7
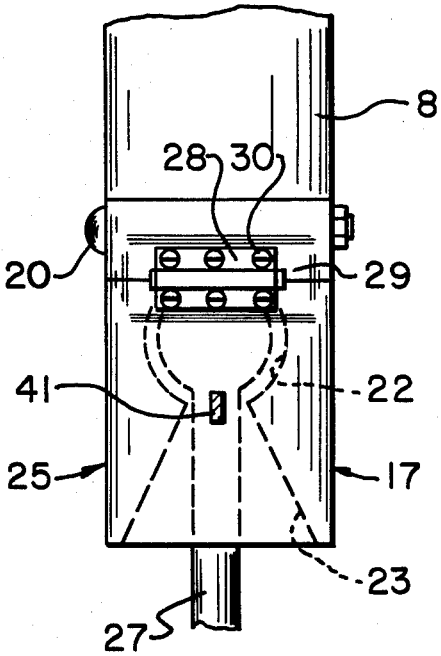
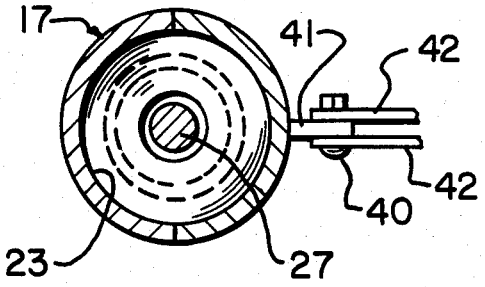
FIG. 6
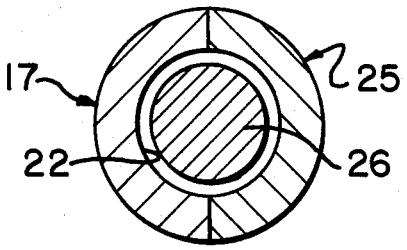
FIG. 8

FLOATING BOAT DOCK ANCHOR

TECHNICAL FIELD

The invention relates to anchors for boat docks and particularly to an anchor construction for a floating boat dock which can be installed and removed easily from the top of the dock for seasonal use.

BACKGROUND ART

Numerous types of boat docks have been constructed and used for the mooring of small boats in lakes or rivers. These docks may consist of a plurality of piles driven into the lake bottom with the dock sections or walkways firmly attached to an upper portion of the pilings. The length and configurations of these permanently mounted piles and dock sections varies considerably depending upon the shoreline and space re-requirements.

Other types of docks use rigid piles driven into the lake bottom with the boat dock sections being mounted on floating drums or barrels. These floating dock sections then are attached to the permanently driven piles. This floating dock construction enables the dock sections to be removed during the winter months reducing deterioration and damage to the sections. However, the pilings are left embedded in the lake bottom due to the difficulty of removing them and the subsequent reinstallation in the spring.

In certain areas, state or local rules require that the piling as well as the dock sections be removed from the lake during the winter months. This requires a considerable amount of work and expense to remove the piles and then reinstall them the following spring for attaching the dock sections thereto.

Therefore, the need has existed for an improved floating boat dock anchor which can be installed and removed easily to permit seasonal use, yet which provides a sufficiently strong and desirable anchor for maintaining the floating dock sections in a desired location.

DISCLOSURE OF INVENTION

Objectives of the invention include providing an improved anchor for a floating boat dock which includes a base that is permanently installed on the bottom of a lake and a tubular portion or post which is easily installed and removed from the base enabling seasonal use of the anchor post and eliminating the heretofore difficult and expensive installation and removal of permanently driven piles into and from the lake bottom; and in which the post portion of the anchor can be installed from the top of the dock sections by the simple manipulation of a pivotally mounted handle.

Another objective is to provide such an anchor in which the post portion consists of one or more lengths of tubes with a cylindrical member mounted on the bottom thereof, in which said cylindrical member has a socket formed therein with a portion thereof being enclosed and formed by a pivotally mounted flap, which enables a spherical-shaped ball which is attached to or formed integrally with a rod that is embedded in the base, to be releasably trapped within the spherical socket to attach the post portion to the base. A further objective is to provide such a dock anchor in which the flap operating handle is attached to the upper end of the post portion and is connected to the lower flap by a lever; and in which the lever may be adjustable to accommodate tube portions of different lengths.

A further objective of the invention is to provide such a boat dock anchor in which the socket forming member and flap portion thereof are cast of lightweight aluminum, in which the socket has a spherical-shaped portion and a truncated lower portion which extends outwardly and downwardly enabling the post portion to rotate on top of the ball within the socket whereby the dock can move in various directions depending upon the wind direction and current flow without placing undue stress and strain on the post, anchor ball, or dock sections; and in which the post is loosely connected to the dock section permitting the dock sections to raise and lower according to the water level without placing any stress on the post while maintaining the dock sections on top of the water.

These objectives and advantages are obtained by the improved floating boat dock anchor construction, the general nature of which may be stated as including post means adapted to be operatively connected to a floating dock for maintaining the dock in a desired position; a base adapted to rest on the bottom of a lake, said base having ball means formed on the base for engagement by the post means; and socket means formed on the bottom of the post means for receiving the ball means therein to removably attach the post means to the base.

BRIEF DESCRIPTION OF DRAWINGS

A preferred embodiment of the invention, illustrative of the best mode in which applicant has contemplated applying the principles, is set forth in the following description and shown in the drawings and is particularly and distinctly pointed out and set forth in the appended claims.

FIG. 4 is an enlarged fragmentary elevational view of the dock anchor as shown in FIG. 2;

FIG. 5 is a sectional view taken on line 5—5, FIG. 4;

FIG. 6 is a sectional view taken on line 6—6, FIG. 4;

FIG. 7 is a fragmentary elevational view taken on line 7—7, FIG. 4;

FIG. 8 is a sectional view taken on line 8—8, FIG. 4;

Similar numerals refer to similar parts throughout the drawings.

BEST MODE FOR CARRYING OUT THE INVENTION

Figure 1:
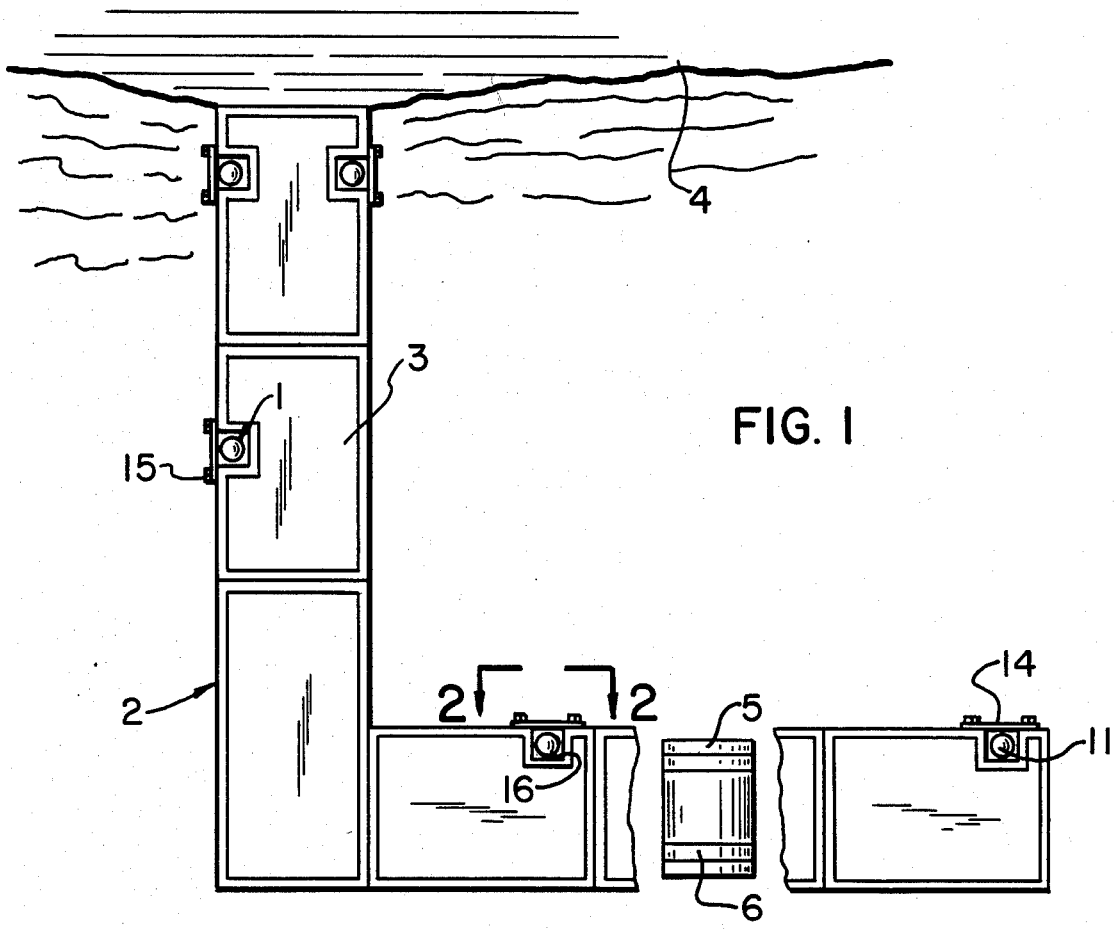
FIG. 1 is a diagrammatic top plan view showing a typical dock installation using the improved anchor.
Figure 2:
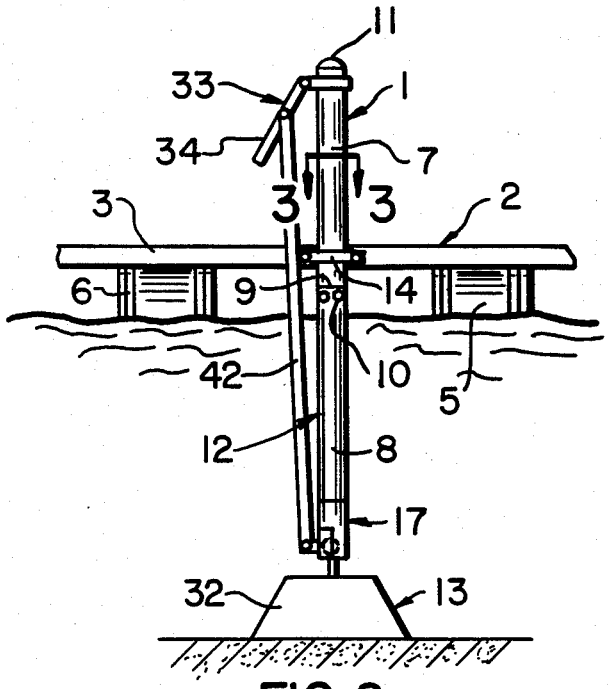
FIG. 2 is a side elevational view of one of the improved dock anchors looking in the direction of arrows 2—2, FIG. 1.

The improved boat dock anchor is indicated generally at 1, and is shown in FIG. 2 connected to a boat dock indicated generally at 2. A plurality of anchors 1 are shown in FIG. 1 in a typical dock installation. Boat dock 2 usually will include a plurality of dock sections 3 which are shown arranged in an L-shaped manner in FIG. 1 extending outwardly from a shoreline 4. Each dock section 3 will be supported by a plurality of floats 5 which are secured to the individual dock sections 3 by straps 6. Floats 5 will be large metal or plastic drums or barrels having sufficient bouyancy to adequately support a dock section 3 with a predetermined amount of weight thereon.

Five of the improved dock anchors 1 are shown in FIG. 1 for anchoring six boat dock sections 3. The number of dock anchors 1 and dock sections 3 will vary depending upon the particular dock configuration. Dock sections 3 may be formed of various materials such as wood planking, aluminum channels, heavy plastic members or similar materials. Improved dock anchor 1 will work satisfactorily with the various constructions and materials of dock section 3.

Figure 3:
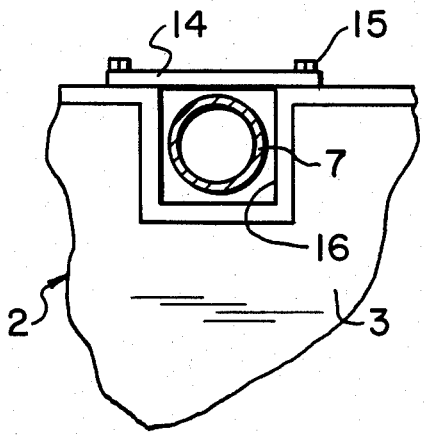
FIG. 3 is an enlarged fragmentary sectional view taken on line 3—3, FIG. 2.

Anchor 1 includes a tubular portion or post 12 and a base 13. Post 12 is formed by one or more preferably hollow cylindrical tubes formed of steel or lightweight aluminum. The particular anchor post shown in FIG. 2 consists of two tubes 7 and 8 joined together at 9 by a bolt 10. A dome-shaped cap 11 preferably is attached to the upper open end of top tube 7. Anchor 1 may be connected to dock sections 3 by various means, one of which is shown particularly in FIG. 3. A rectangular-shaped cutout 16 is formed in dock section 3 having an open side which is closed by a strap 14. Cutout 16 is slightly larger than the outer diameter of upper tube 7 to provide a loose fit therebetween permitting dock section 3 to raise and lower with the water level without binding against anchor tube 7. Strap 14 is connected to dock section 3 by bolts 15 or other fastening means. If desired, post 12 may be mounted along the outer edge of dock section 3 by a cable or a U-shaped strap which would provide a similar loose fit with tube 7.

Figure 9:
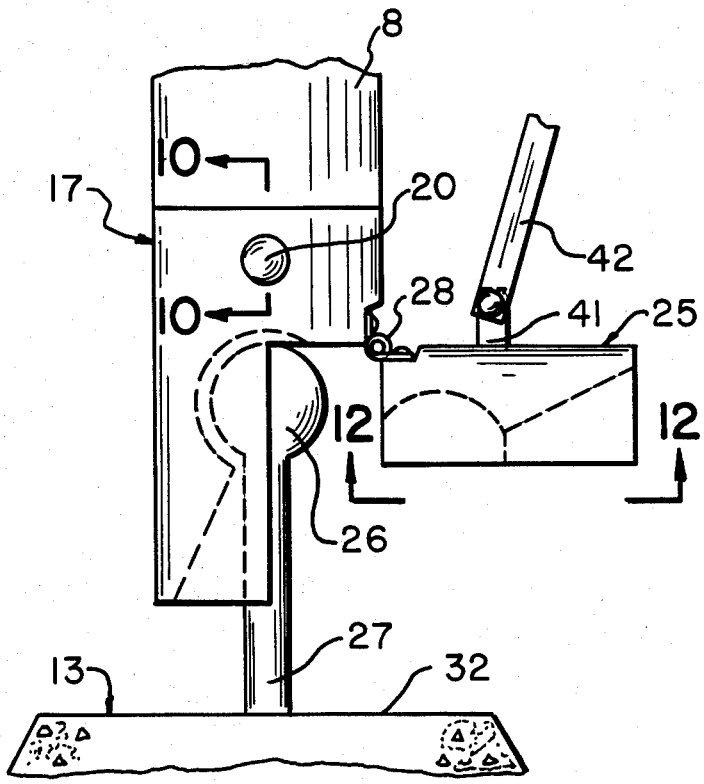
FIG. 9 is a fragmentary elevational view showing the flap of the socket forming member in open position with the ball being located within the socket.
Figure 10:
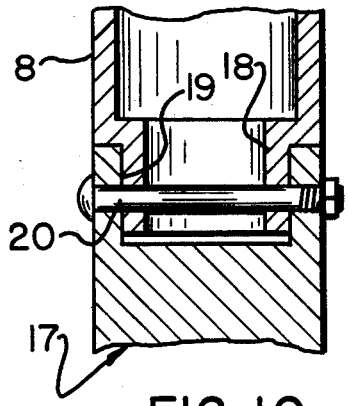
FIG. 10 is a fragmentary sectional view taken on line 10—10, FIG. 9.

In accordance with one of the features of the invention, a socket member 17 (FIGS. 4, 6, 7, 9 and 11) is mounted on the lower end of anchor tube 8. Socket member 17 preferably is formed of cast aluminum, and has a cylindrical outer configuration complementary to tubes 7 and 8. Tube 8 may be connected to member 17 by an arrangement such as shown in FIG. 10 in which the lower end of tube 8 has a reduced diameter cylindrical portion 18 which is telescopically inserted within a cylindrical open end 19 formed in the top of socket member 17. A bolt 20 extends through aligned openings formed in socket member 17 and tube 8 to connect tube 8 and member 17. Other types of connecting means may be used without affecting the concept of the invention.

Figure 12:
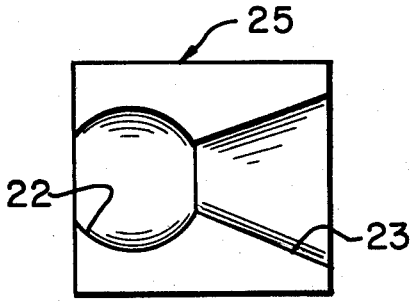
FIG. 12 is a plan view looking in the direction of arrows 12—12, FIG. 9.
Figure 11:
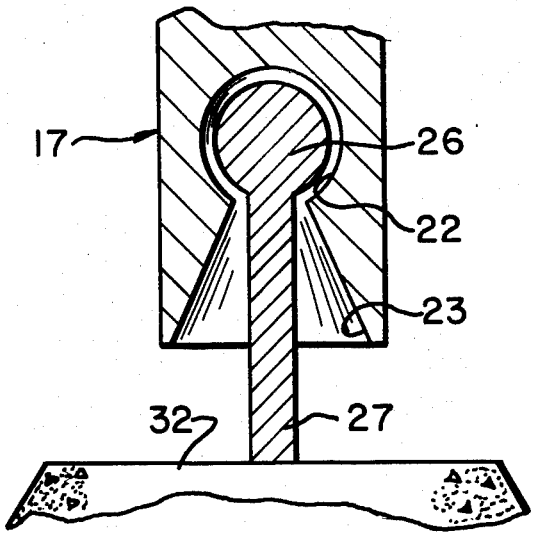
FIG. 11 is a fragmentary sectional view taken on line 11—11, FIG. 4.

Socket member 17 is formed with a generally spherical-shaped socket 22 which communicates with a downwardly outwardly flaired truncated-shaped opening 23 (FIG. 11). Socket member 17 is provided with a pivotally mounted flap 25 (FIGS. 4, 7, 9 and 12) movable between an open position as shown in FIG. 9 and a closed position as shown in FIG. 4 for trapping a ball-shaped member 26. Ball 26 preferably is formed integrally with and located on top of a rod 27. Flap 25 has a generally semi-cylindrical-shaped configuration and forms a lower portion of socket member 17. Flap 25 is connected to an upper portion of section 17 by a hinge 28. Hinge 28 is mounted on a flat area 29 (FIG. 7) which is formed partially on the upper portion of member 17 and the upper portion of flap 25. Hinge 28 is secured in to flat area 29 by a plurality of screws 30 or other fastening means. When flap 25 is in the closed position of FIGS. 4 and 7, it provides a generally cylindrical configuration to socket member 17. A portion of socket 22 is formed in flap 25 as shown by dotted line 31 in FIG. 9 and in FIG. 12.

Base 13 includes rod 27 which is embedded in a concrete base 32 (FIG. 2). Rod 27 projects upwardly a short distance from base 32 terminating in ball 26. Base 32 preferably will be formed on site by usual fabricating means wherein a hollow form is placed on the bottom of the lake and then filled with concrete which hardens to form a permanent base for attachment of post 12. Base 32 will remain in position after post 12 is removed during the winter months for storage. Other types of bases 32 may be used, such as an enlongated pole or pile driven into the bottom of the lake with rod 27 projecting upwardly therefrom and terminating in ball 26. However, a concrete base is believed to be the most economical and practical construction.

In accordance with another feature of the invention, flap 25 is pivotally moved between open and closed positions by a lever mechanism indicated generally at 33, and shown particularly in FIG. 4. Lever mechanism 33 includes an operating handle 34 which is pivotally mounted by a bolt 35 to the extended end of a strap 36 which encircles the top of tube 7 and is clamped thereon by a bolt 37 (FIG. 5). A lever 38 formed by a pair of spaced steel strips 42 is pivotally mounted at an intermediate position on handle 34 by a bolt 39 and is pivotally mounted at its lower end by bolt 40 to a stud 41 formed integrally with or welded to flap 25 (FIGS. 6 and 7).

The operation of boat dock anchor 1 can be best understood by reference to FIGS. 2 and 4. Concrete base 32 and rod 27 are installed at the necessary location and will remain in position at all times. The positions of bases 32 will enable the same dock configuration to be used year after year. If desired, other bases can be installed for expanding or modifying the dock configuration. At the start of the boating season in spring, dock sections 3 will be mounted on the required number of floats 5 and placed at the approximate position of bases 32. Posts 12 are installed easily by moving operating handle 34 in a counterclockwise direction (FIG. 4) moving flap 25 to the open position of FIG. 9. This enables socket member 17 of post 12 to be placed on top of rod 27 with ball 26 being located within socket 22.

Figure 13:
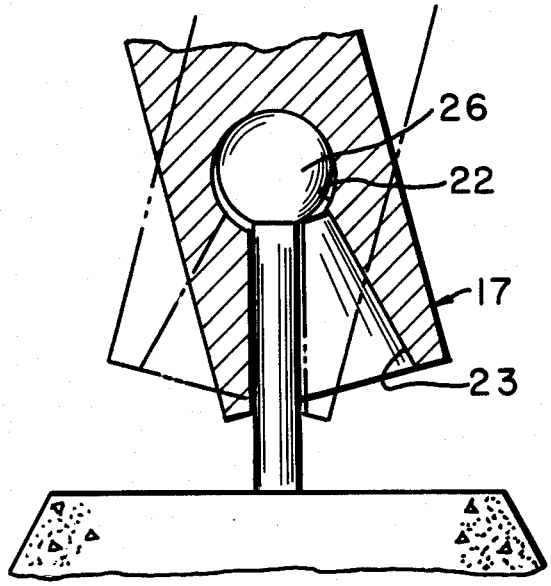
FIG. 13 is a diagrammatic fragmentary view similar to FIG. 11 showing the anchor in various positions.

In FIGS. 4, 5, 6, 9 and 11, ball 26 is shown located in the center of socket 22 for clarity. However, in an actual installation ball 26 provides the support for post 12 and ball 26 will engage the upper curved portion of socket 22 as shown in FIG. 13. After ball head 26 is seated in socket 22, handle 34 will be rotated in the opposite direction moving flap 25 to a closed position to capture ball 26 within socket 22 preventing disengagement of socket member 17 from ball 26. If desired, handle 34 can be locked in the closed flap position by various types of locking mechanisms. Anchors 1 are then connected to their respective dock sections 3 by straps 14 or other attachment means for connecting the anchors to the dock sections.

In addition to providing a readily attachable anchor for securing boat dock sections in position, dock anchor 1 also enables limited movement of the dock sections without damaging the dock or anchor due to waves or similar rough weather conditions. Post 12 can pivot a limited number of degrees on ball 26 due to the tapered configuration of truncated opening 23 and the preferably loose sliding pivotal connection between ball 26 and socket 22 as shown in FIG. 13. Also, the top opening of truncated opening 23 at the junction with socket 22 is smaller than the diameter of ball 26 preventing disengagement of socket member 17 from the ball head when flap 25 is in the closed position.

At the close of the boating season, posts 12 are removed easily by unlocking lever 34 and rotating the same in a counterclockwise direction (FIG. 4) which moves flap 25 to the open position of FIG. 9 enabling tubes 7 and 8 and socket members 17 to be disengaged from ball 26 after removal of dock section strap 14. Tubes 7 and 8, socket member 17 and connected lever mechanism 33 which form a unit then can be easily transported to a storage site for the winter.

Accordingly, the improved floating boat dock anchor is simplified, provides an effective, safe, inexpensive, lightweight and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved floating boat dock anchor is constructed and used, the characteristics of the construction, and the advantageous, new and useful results obtained; the new and useful structures, devices, elements, arrangements, parts, and combinations, are set forth in the appended claims.

What is claimed is:

1. An anchor construction for a floating dock including:

(a) post means adapted to be operatively connected to a floating dock for maintaining the dock in a desired position;

(b) a base adapted to rest on the bottom of a lake said base having ball means formed on the base for engagement by the post means;

(c) spherical-shaped socket means formed on the bottom of the post means for receiving the ball means therein to removably attach and lock the post means to the base;

(d) a flap pivotally mounted on the bottom of the post means and communicating with the socket means to enable the ball means to be locked on and unlocked from the socket means;

(e) lever means connected to the flap and extending upwardly along the post means; and (f) an operating handle mounted on an upper portion of the post means and connected to the lever means for operating the flap from the dock for locking and unlocking the post means to and from the ball means on the base.

2. The anchor construction defined in claim 1 in which the ball means includes a rod embedded in the base and projecting upwardly therefrom; and in which a spherical-shaped ball is mounted on the top of the rod and is received within the socket means of the post means.

3. The anchor construction defined in claim 1 in which the post means includes a cylindrical hollow tube adapted to be loosely connected to the dock permitting limited movement therebetween; in which the socket means includes a cylindrical member mounted on a lower end of the tube having the spherical shaped socket formed therein; and in which the pivotally mounted flap is formed as a part of the cylindrical member and is movable between open and closed positions for capturing the ball means within the socket to removably mount the post means on the base.

4. The anchor construction defined in claim 3 in which the flap has a semicylindrical outer configuration and is pivotally mounted by a hinge on the cylindrical member; and in which lever means is connected to the flap for pivotally moving the flap from a position on a dock for removably capturing the ball means in the socket.

5. The anchor construction defined in claim 3 in which the socket has a generally spherical-shaped upper portion and a truncated lower portion extending downwardly outwardly from the spherical-shaped upper portion.

6. The anchor construction defined in claim 5 in which a portion of the socket and truncated lower portion is formed in the cylindrical member and a mating portion of said socket and truncated lower portion is formed in the flap.

7. The anchor construction defined in claim 5 in which the ball means includes a spherical-shaped ball mounted on top of a rod which is embedded within the base and projects upwardly therefrom; and in which the rod extends through the truncated lower portion of the socket permitting limited rocking movement of the post means on the base.

8. The anchor construction defined in claim 3 in which the cylindrical socket forming member is formed of cast metal.

9. The anchor construction defined in claim 1 in which the post means is adapted to be loosely connected to a dock by a strap which permits limited movement between the dock and post means.

* * * * *